US008112939B2

(12) United States Patent
Miller et al.

(10) Patent No.: US 8,112,939 B2
(45) Date of Patent: Feb. 14, 2012

(54) OSCILLATING SELF-CENTERING TRAFFIC-DOOR

(76) Inventors: Peter Miller, Wauconda, IL (US); Duer Miller, Wauconda, IL (US)

( * ) Notice: Subject to any disclaimer, the term of this patent is extended or adjusted under 35 U.S.C. 154(b) by 771 days.

(21) Appl. No.: 11/371,438

(22) Filed: Mar. 8, 2006

(65) Prior Publication Data

US 2007/0193118 A1 Aug. 23, 2007

Related U.S. Application Data

(60) Provisional application No. 60/762,399, filed on Jan. 26, 2006.

(51) Int. Cl.
*E05D 7/06* (2006.01)
*E05F 1/04* (2006.01)

(52) U.S. Cl. ..... 49/236; 49/381; 49/245; 49/208; 49/239

(58) Field of Classification Search ..... 49/381, 49/236–239, 292, 245, 208
See application file for complete search history.

(56) References Cited

U.S. PATENT DOCUMENTS

| | | | | |
|---|---|---|---|---|
| 2,827,117 | A * | 3/1958 | Bateman | 160/327 |
| 3,384,996 | A * | 5/1968 | Gilchrist et al. | 49/383 |
| 4,026,069 | A * | 5/1977 | Bohnett | 49/49 |
| 4,078,334 | A * | 3/1978 | Lambias | 49/237 |
| 4,292,764 | A * | 10/1981 | Kochis | 49/237 |
| 4,570,384 | A * | 2/1986 | Eckel | 49/501 |
| 5,012,616 | A * | 5/1991 | Martin | 49/501 |
| 5,050,344 | A * | 9/1991 | Skeem | 49/237 |
| 5,133,152 | A * | 7/1992 | Grancagnolo | 49/239 |
| 5,500,984 | A * | 3/1996 | Lee | 16/309 |
| 5,615,520 | A * | 4/1997 | McGuire | 49/237 |
| 5,644,870 | A * | 7/1997 | Chen | 49/501 |
| 5,711,121 | A * | 1/1998 | Garver | 52/239 |
| 5,743,588 | A * | 4/1998 | Ufrecht | 296/146.6 |
| 6,990,772 | B2 * | 1/2006 | Eckel et al. | 49/236 |
| 7,114,290 | B2 * | 10/2006 | Stubbe | 49/274 |
| 7,429,032 | B2 * | 9/2008 | Stull | 256/73 |
| 7,526,894 | B2 * | 5/2009 | Falato et al. | 49/236 |
| 2004/0115350 | A1 * | 6/2004 | Bolton et al. | 427/262 |
| 2004/0172882 | A1 * | 9/2004 | Kern et al. | 49/231 |
| 2005/0266222 | A1 * | 12/2005 | Clark et al. | 428/292.1 |
| 2005/0284030 | A1 * | 12/2005 | Autovino et al. | 52/1 |
| 2006/0267357 | A1 * | 11/2006 | Semtilli | 292/341.16 |

FOREIGN PATENT DOCUMENTS

FR 2594171 A1 * 8/1987

* cited by examiner

*Primary Examiner* — Katherine Mitchell

(74) *Attorney, Agent, or Firm* — The Eclipse Group LLP

(57) ABSTRACT

A door that has a beam and door panel that are secured by molding the door panel to the beam.

21 Claims, 14 Drawing Sheets

OSCILLATING SELF-CENTERING TRAFFIC-DOOR

RELATED APPLICATION

This application claims priority to the provisional patent application, Ser. No. 60/762,399, titled OSCILLATING SELF-CENTERING TRAFFIC-DOOR, by Peter Miller and Duer Miller filed on Jan. 26, 2006, and incorporated by reference herein.

BACKGROUND OF THE INVENTION

1. Field of the Invention

This invention relates generally to interior doors and more particularly to traffic doors.

2. Related Art

Often in retail stores, grocery stores and warehouses, interior doors are used to separate one area from another part of the building. Traditionally, these doors separate the public area of a store from the back area/stock area of the store. Unlike a normal wooden or metal door, these interior doors often have to be wide enough to move pallets and other large/bulk containers through (sometimes with the aid of a forklift). Thus, the term traffic-door has been adopted to describe these types of doors.

The requirement for traffic-doors does vary, but in general they are self-centering bi-directional doors. Previous approaches to constructing a traffic door have included hanging the traffic door from the top of the doorjamb, where the top jamb supports the majority of weight and the moving parts of the traffic-door are exposed. Often the moving parts require lubrication that collects dust and dirt. The dust and dirt create friction that degrades the opening of the door and eventually causes failure of the traffic door. Further, the exposed moving parts are vulnerable to mechanical traffic, such as forklifts and crates, hitting the exposed moving parts as they move through the door.

Other approaches have involved dual hinged doors where one set of hinges swings one direction and then another set of hinges enables the door to swing in the opposite direction. Problems with this approach and the other previous approaches include the doorjamb being damaged by the traffic-door hanging off the doorjamb, increased cost from additional hardware (extra hinges), and the inability of materials used in the traffic-door to withstand the normal abuse encountered during normal use.

Therefore, there is a need for methods and systems for creating and installing traffic-doors that overcomes the disadvantages set forth above.

SUMMARY

Systems and methods consistent with the present invention provide an approach for fabricating and operating an oscillating self-centering traffic-door. A beam may contain an oscillator and is rotatable about a support pin. The beam is configured to accept and support a panel that is attached to the beam via a channel in the beam. The mounting of the support pin and configuration of the beam may also enable the oscillating self-centering traffic-door to rotate 270 degrees. Alternately, the beam may support the pin that rotates on the oscillator that is fixed to the floor.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION

Unlike the known approaches previously discussed, an oscillating self-centering traffic-door with a beam that is not supported by a doorjamb that overcomes the above limitations is described.

Figure 1:
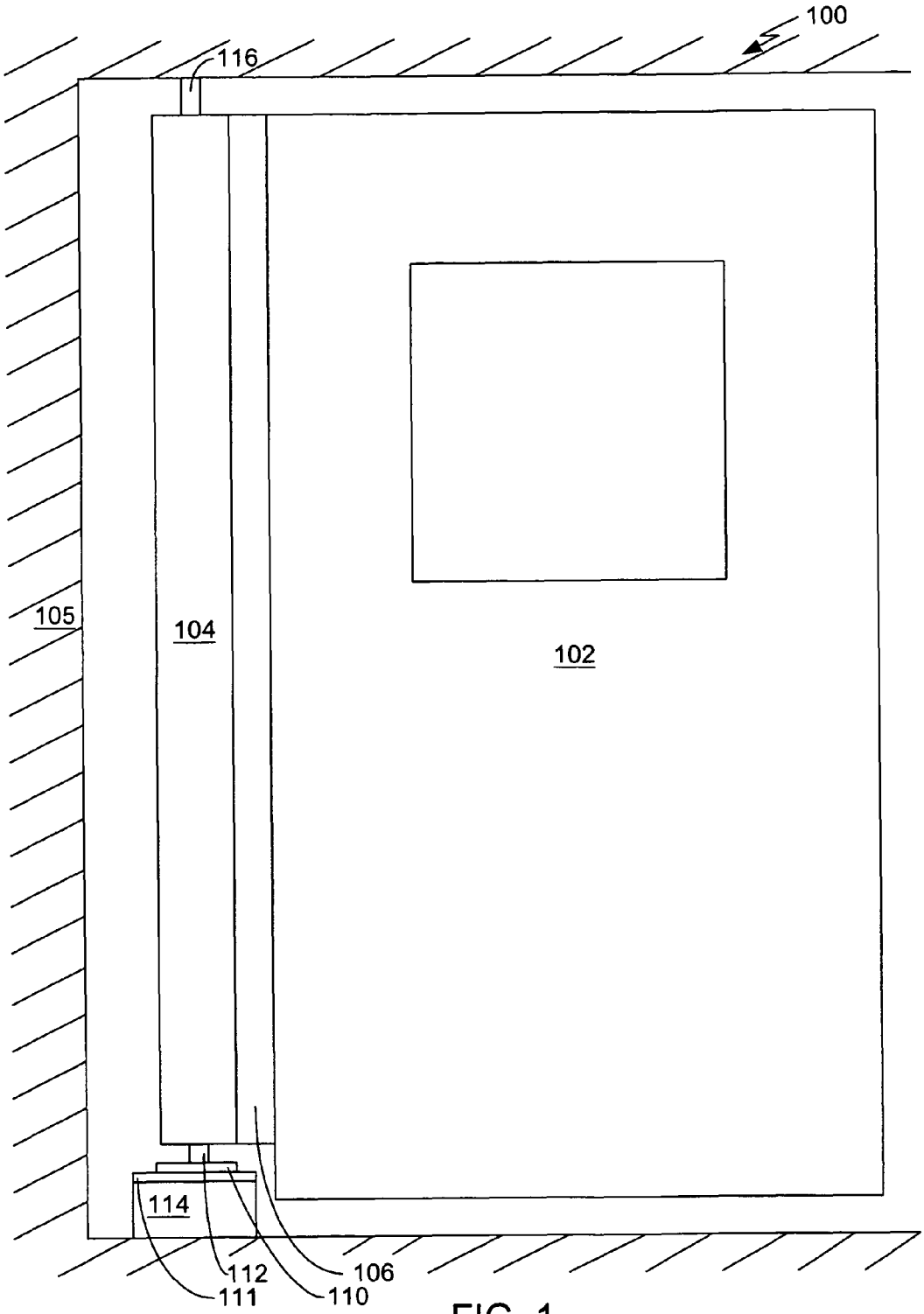
FIG. 1 illustrates an oscillating self-centering traffic-door with a beam in accordance with an example implementation of the invention.

Turning first to FIG. 1, an illustration 100 of an oscillating self-centering traffic-door with a beam 104 in accordance with an example implementation of the invention is shown. The oscillating self-centering traffic-door may be comprised of a door panel 102 that is attached to a beam 104 that has a centering pin 116 at the top of the beam 104 attached to the doorjamb 105. The bottom of the beam 104 may contain an oscillator that engages a support pin 112. The support pin 112 may pass through an alignment plate 110 that may rest on a sup port plate 111. In other implementations, the support pin 112 may be fixed to a single support plate. The plate may be supported by a jamb guard 114 that may help protect the plate 110 and supporting pin 112 from strike damage. The door panel 102 and beam 104 may also have seals 118, 120, and 122 located around the door to prevent dust, odors, and hot/cold air from passing through the closed door.

The beam 104 may be attached to the door panel 102 by means of a channel 106 that clamps the door panel. The channel 106 may be glued, riveted, bolted or fastened using fasteners to the door panel 102. The channel 106 may be molded with the beam out of metal, welded to the beam 104 or attached with fasteners. In other implementations, other approaches to attaching a beam 104 to the door panel 102 may be used, such as having a notch part way or fully along the length of the beam 104.

Figure 2:
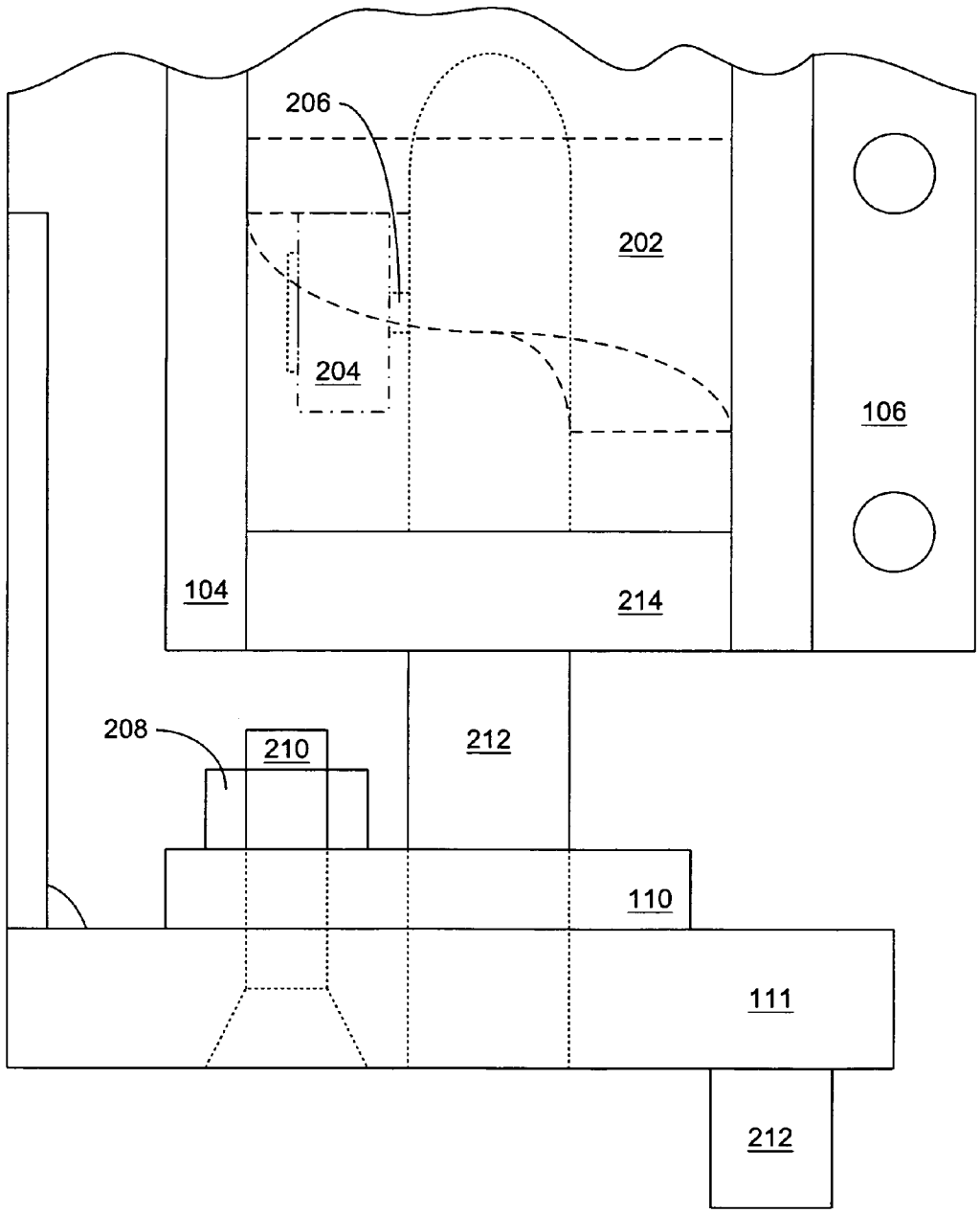
FIG. 2 illustrates an oscillating mechanism located within a beam of FIG. 1 in accordance with the example implementation of the invention.

In FIG. 2, an illustration of an oscillating mechanism 202 located within a beam 104 of FIG. 1 in accordance with the example implementation of the invention. The plate 110 may be bolted to the jamb guard 114 with bolt 210 and secured by nut 208. The support plate 111 may be further secured from movement by pin 212. Pin 212 may be molded with the support plate 111 or secured to support plate 111 by welding, screwing, or with other known approaches to securing a pin in a plate. Plate 110 may be configured to allow for adjustments to the supporting pin 112 that supports beam 104.

The supporting pin 112 enters the beam 104 and may have one or more support wheels, such as 204 attached to the supporting pin 112 by an axle 206. An oscillator 202 may be secured to the inside of the beam 104 and is able to rotate upon support wheel 204. The ends of the beams may be sealed using plugs, such as 214 that allow the support pin 112 to pass through and freely rotate. The beam 104 is also shown in FIG. 2, with channels 106 having holes for fasteners that would secure the door panel 102 to the beam. In another example implementation, the oscillator in the beam may be placed in a jamb guard or even in the floor with the beam being affixed or coupled to the shaft that sets into the jamb guard.

Figure 3:
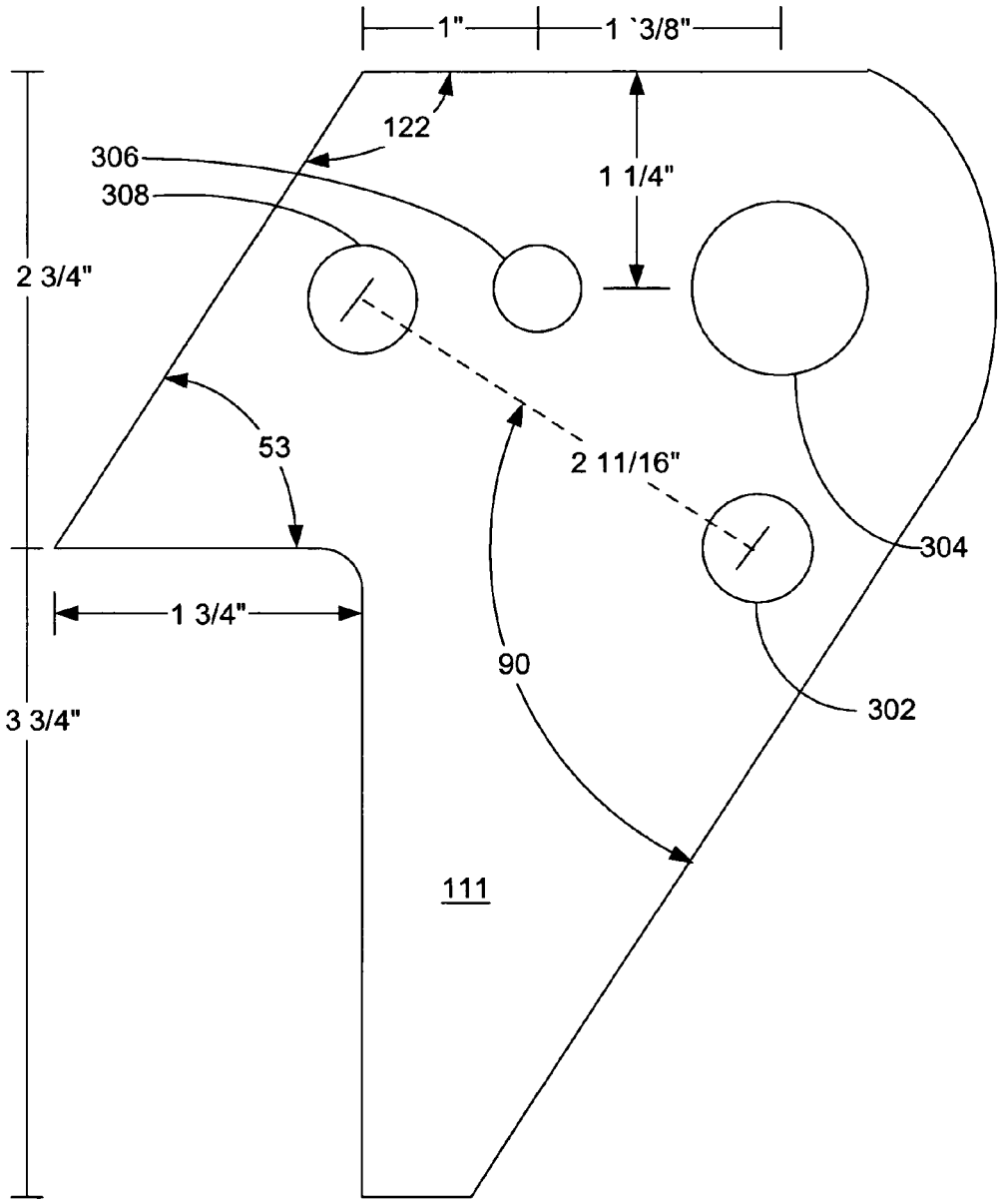
FIG. 3 illustrates a pin plate that supports the oscillating mechanism located in the beam of FIG. 2 in accordance with the example implementation of the invention.

Turing to FIG. 3, an illustration of a support plate 111 that steadies beam 104 of FIG. 2 in accordance with the example implementation of the invention is shown. The support plate 111 is shaped to allow an oscillating self-centering traffic-door to have a 270-degree range of motion. The support plate 111 may have a number of holes that enable pins and bolts to pass through it or to be fixed to the support plate 111. Hole 302 may have a radius of ⅝", hole 304 may have a radius of 1", hole 306 may have a radius of ½" and be tapped, while hole 308 may have a radius of ⅝". In other implementations, the number of holes, size of holes and shape of the support plate 111 may be changed and some of the holes may eliminate or additional holes may be added.

Figure 4:
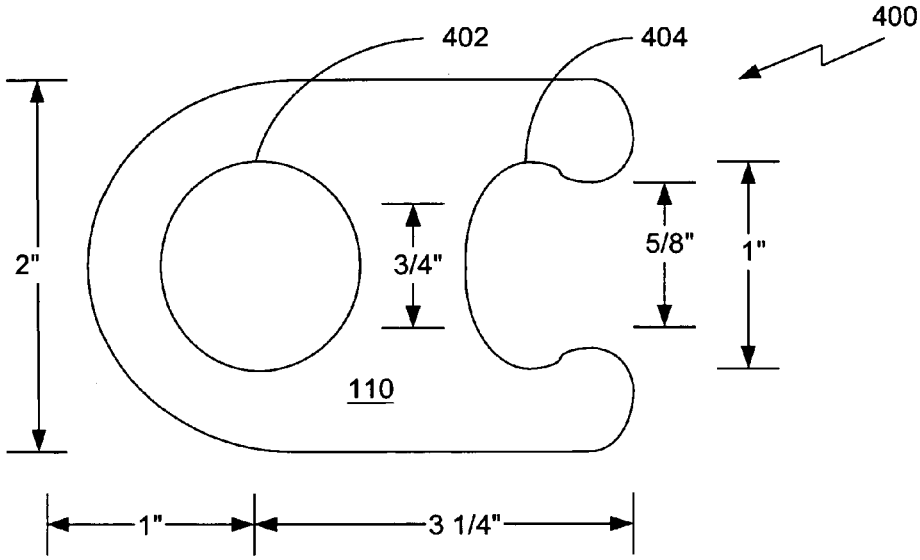
FIG. 4 illustrates an adjustment plate in accordance with the example implementations of the invention.

In FIG. 4, an illustration 400 of an adjustment plate 110 that adjusts the oscillating mechanism of FIG. 2 in accordance with the example implementation of the invention is shown. The adjustment plate 110 may have a hole 402 and a notch 404 opposite the hole. The arms of the notch partially enclose the notch 404 opening. The adjustment plate 110 may be used to adjust the bow of oscillating self-centering traffic-door and rest on the support plate 111. The adjustment plate 110 in other implementations may have more or fewer holes than shown in FIG. 4 and similarly, the notch may be shaped differently.

Figure 5:
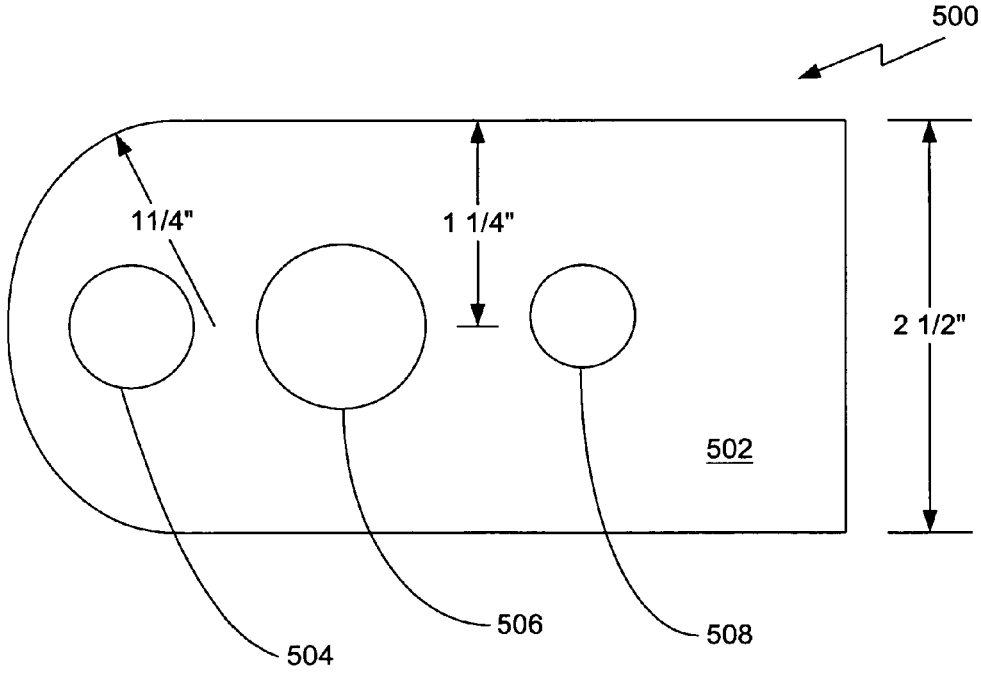
FIG. 5 illustrates another implementation of a pin plate that may be integral with the support pin of FIG. 2 in accordance with another example implementation of the invention.

In FIG. 5, an illustration 500 of another implementation of a support plate 502 that adjusts the oscillating mechanism of FIG. 2 in accordance with the example implementation of the invention is shown. The adjustment plate 502 may have a ⅝" hole 504, 1" hole 506 and another ½" tapped and counter sunk hole 508. The adjustment plate 502 may be used to adjust the bow of oscillating self-centering traffic-door and rest on the support plate 111. The adjustment plate 502 in other implementations may have more or fewer holes.

Figure 6:
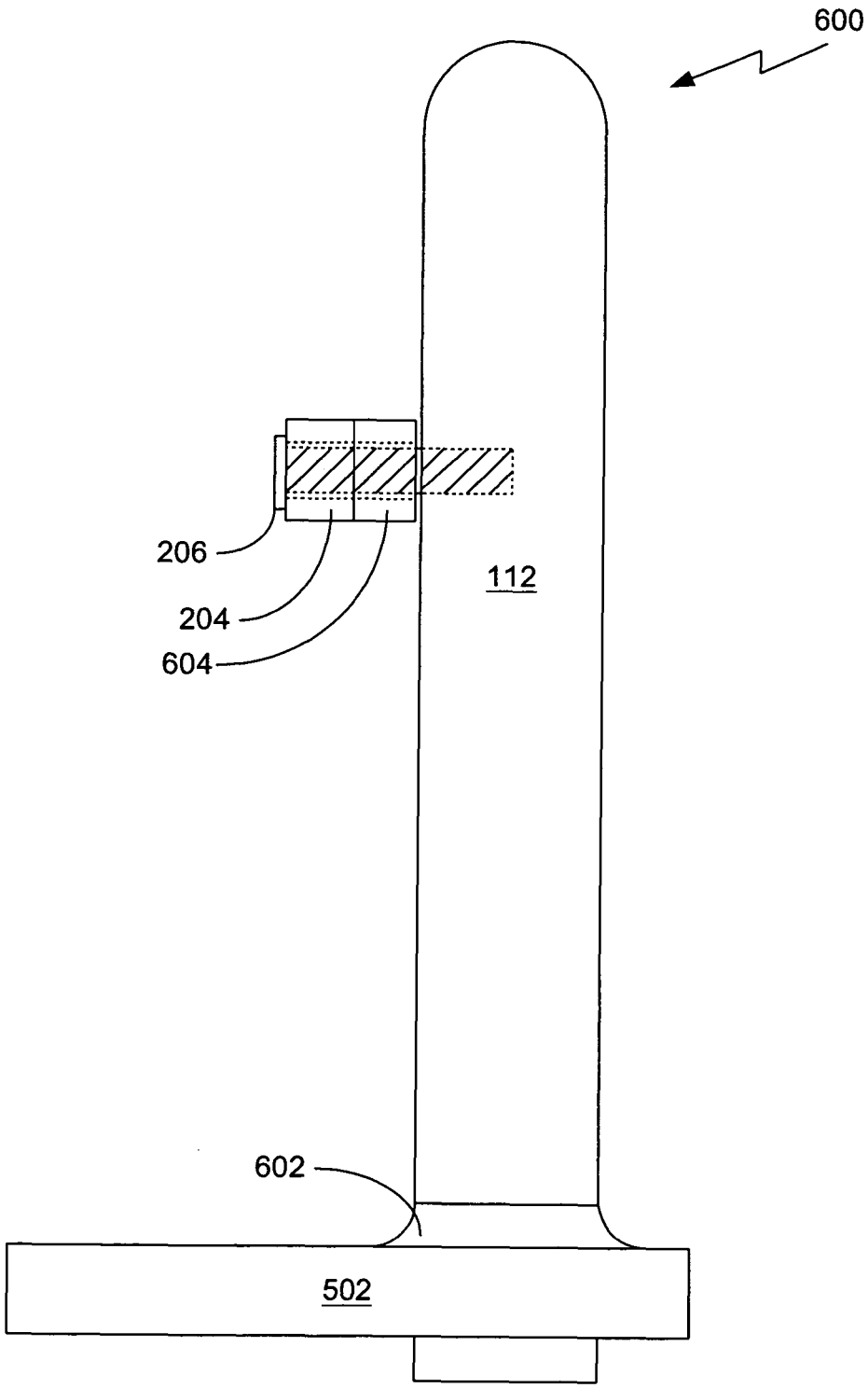
FIG. 6 illustrates a pin that supports the oscillating mechanism of FIG. 2 and passes through the pin plate of FIG. 5 in accordance with the example implementation of the invention.

Turning to FIG. 6, an illustration 600 of the pin 112 that supports the oscillating mechanism 202 of FIG. 2 and passes through the support plate of 502 of FIG. 5 in accordance with the example implementation of the invention is shown. The support pin 112 passes through support plate 502 and may be welded with a weld 602 to the adjustment plate 112. In other implementations, the connection between the support pin 112 and support plate 502 may be by friction, glue, bolt, or even one or more pins.

The upper portion of the support pin 112 may have a bolt 206 that is terminated in the support pin 112 and retains the support wheel 204 and a second support wheel 604. The support wheels may be made out of polyester, or other material with a low coefficient of friction. In other implementations, bearings may be used within the support wheels 204 and 604 to enable the support wheels 204 and 604 to turn.

Figure 7:
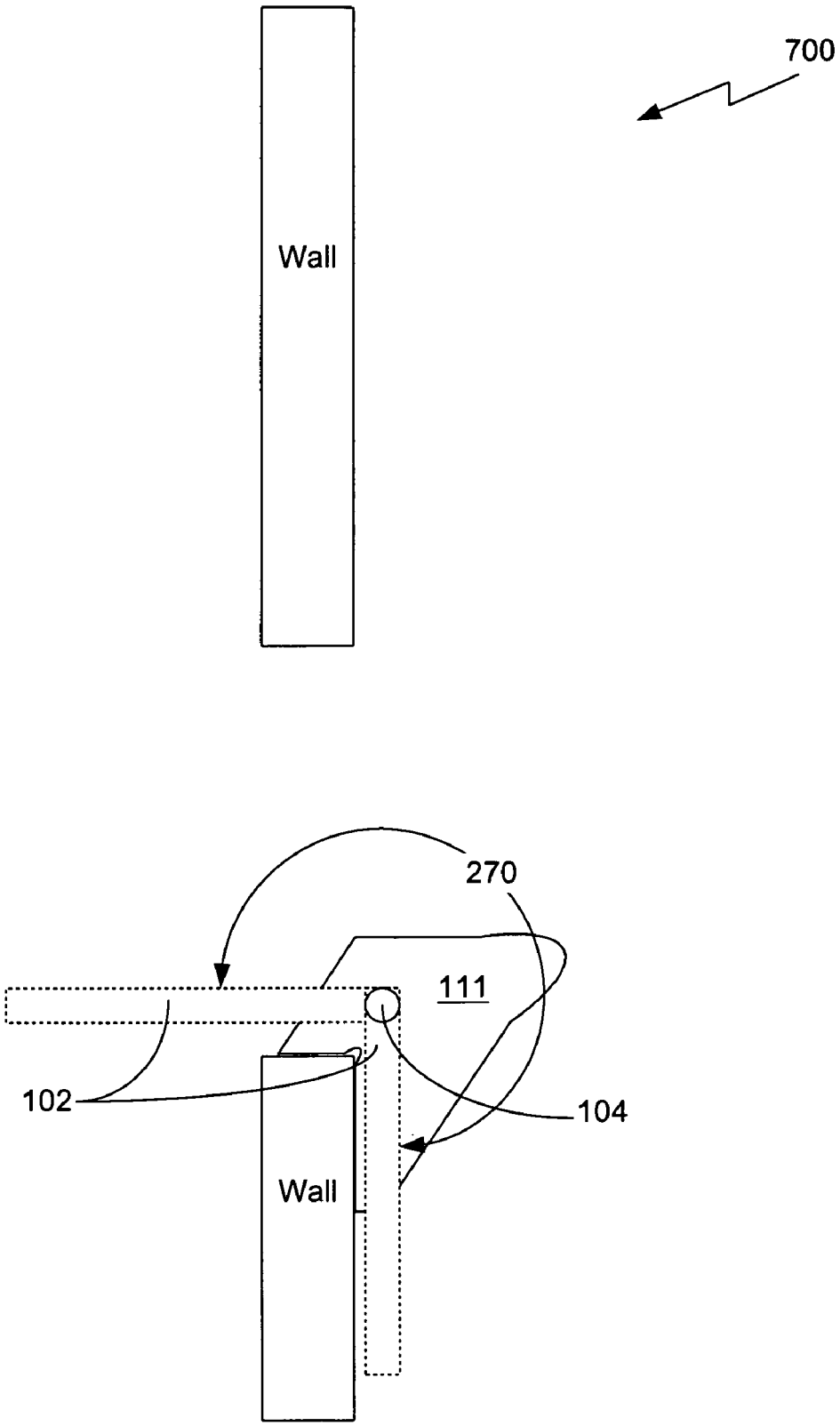
FIG. 7 illustrates the placement of the support plate that adjusts the oscillating mechanism of FIG. 2 and enables 270-degree operation of the oscillating self-centering traffic-door in accordance with the example implementation of the invention.

In FIG. 7, an illustration 700 of the placement of the support plate 111 that adjusts the oscillating mechanism of FIG. 2 and enables 270-degree operation of the oscillating self-centering traffic-door in accordance with the example implementation of the invention is shown. The support plate 111 locates the beam 104 partially out of alignment from the walls and enables the door panel 102 270-degrees of movement. The beam 102 and door panel may have seals that allow the opening around the door to provide a seal to block dirt, air, or odors from passing unobstructed through the door.

Figure 8:
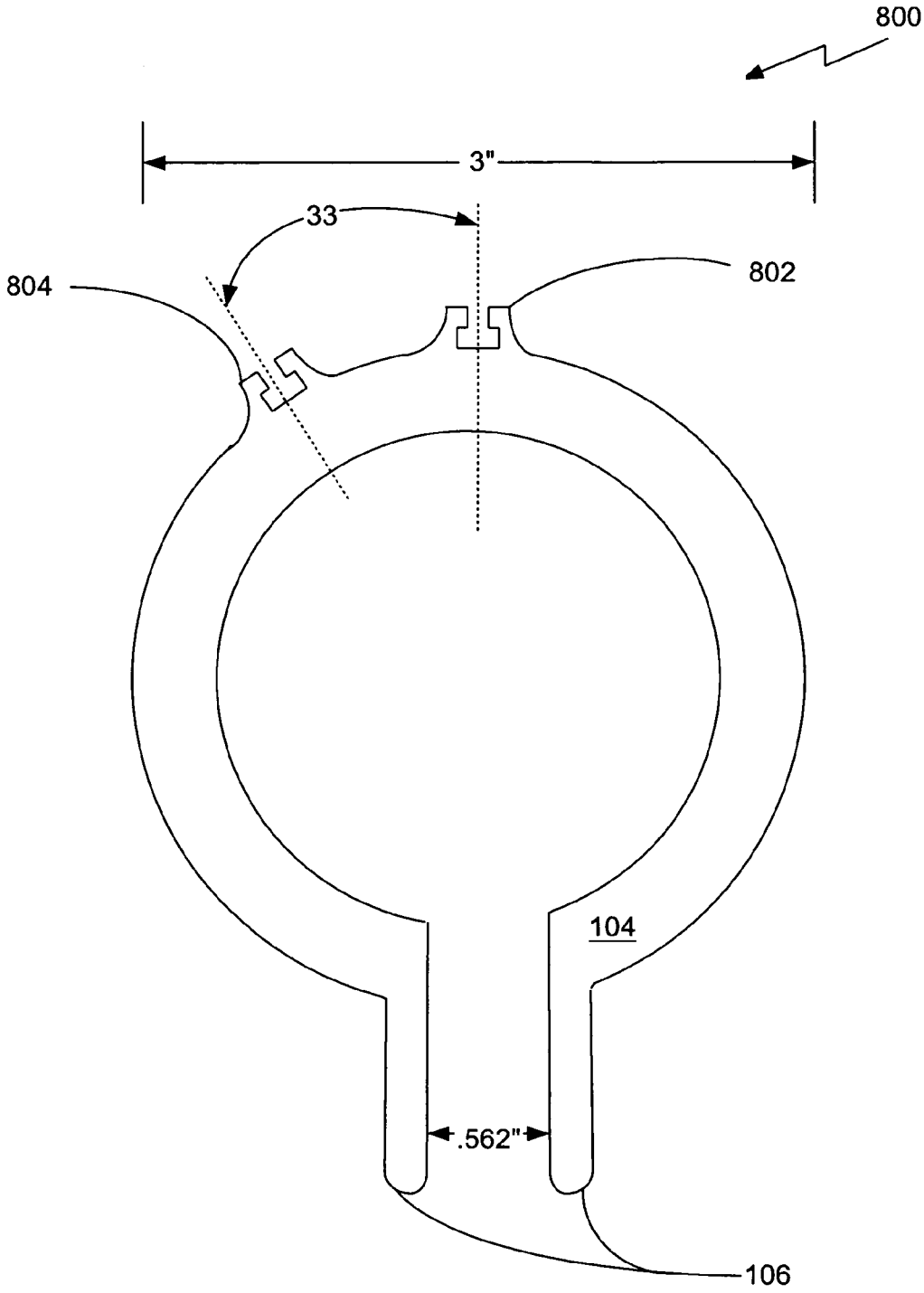
FIG. 8 illustrates a cross sectional view of a beam with door seal channels.

Turning to FIG. 8, an illustration 800 of a cross sectional view of beam 104 of FIG. 2 with seal channels 802 and 804 for door seals. The seal channels 802 and 804 for door seals are shown as being 33 degrees apart from the channels 106 that hold the door panel. When the oscillating self-centering traffic-door is in the closed position the seal channel 802 will be across from the doorjamb and seals that reside in both seal channels 802 and 804 may engage the doorjamb. When the oscillating self-centering traffic-door is open, one of the door seals may engage the doorjamb. The door seals may be made out of rubber, plastic, or other structures that may seal the door without affecting the oscillating self-centering traffic-door's movement. In some implementations the seal may be a solid strip, while others the seal may be more like a brush.

Figure 9:
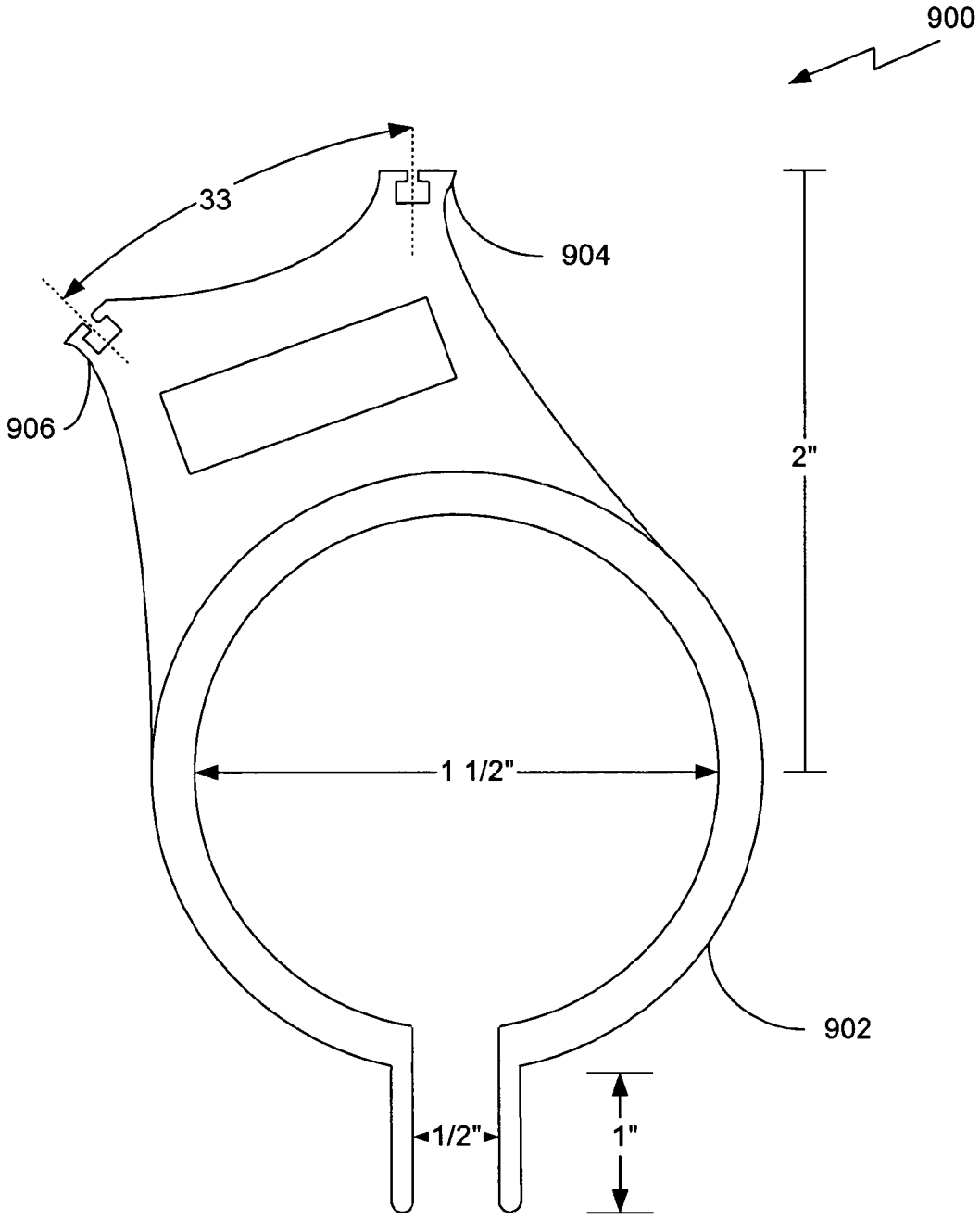
FIG. 9 illustrates a cross sectional view of a beam with two door seals that may be used with a support plate that enables 270 degrees of motion.

In FIG. 9, an illustration 900 of a cross sectional view of another beam 902 with two seals that may be used with the support plate that enables 270-degrees of motion is shown. The two seals may be fixed to the beam by seal channel 904 and 906. Unlike beam 104 of FIG. 8, the seal channels are rotated off center to enable the seal to be maintained through out the 270-degree opening. Similar to the beam 104 of FIG. 8, the seal channels 904 and 906 are spaced 33 degrees apart.

Figure 10:
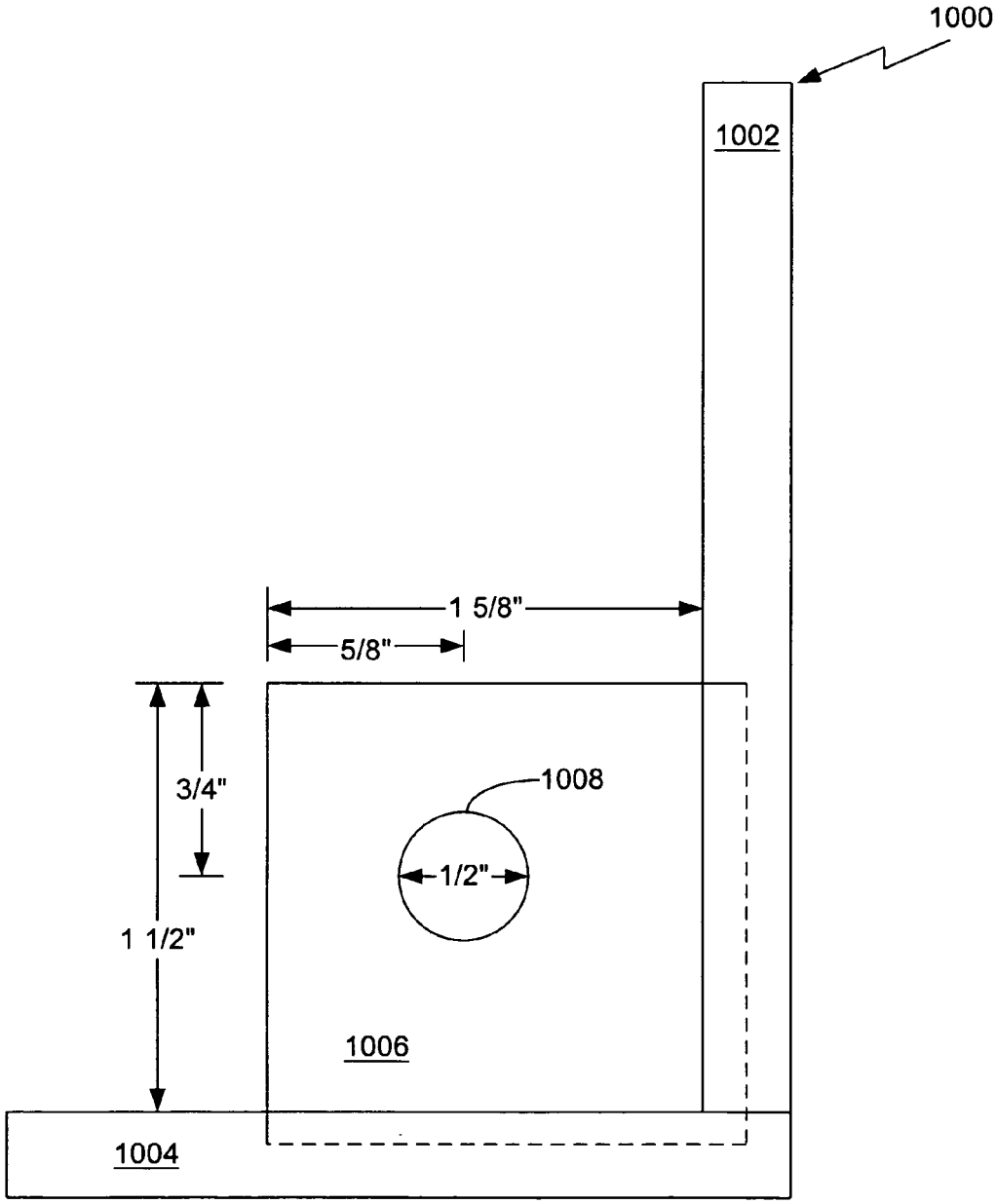
FIG. 10 illustrates a spline assembly that is fixed to a jamb plate and a floor plate in another example implementation of the invention.

In FIG. 10, an illustration of a spline assembly 1000 that is fixed to a jamb plate 1002 and a floor plate 1004 in another example of the invention is shown. The spline 1006 is attached to both the jamb plate 1002 and floor plate 1004 in the current example by welding, but in other implementations, it may be molded as single piece, screwed, bolted, or held by adhesives. The spline 1006 may have ½" hole 1008 that is able to have a bolt pass through it.

Figure 11:
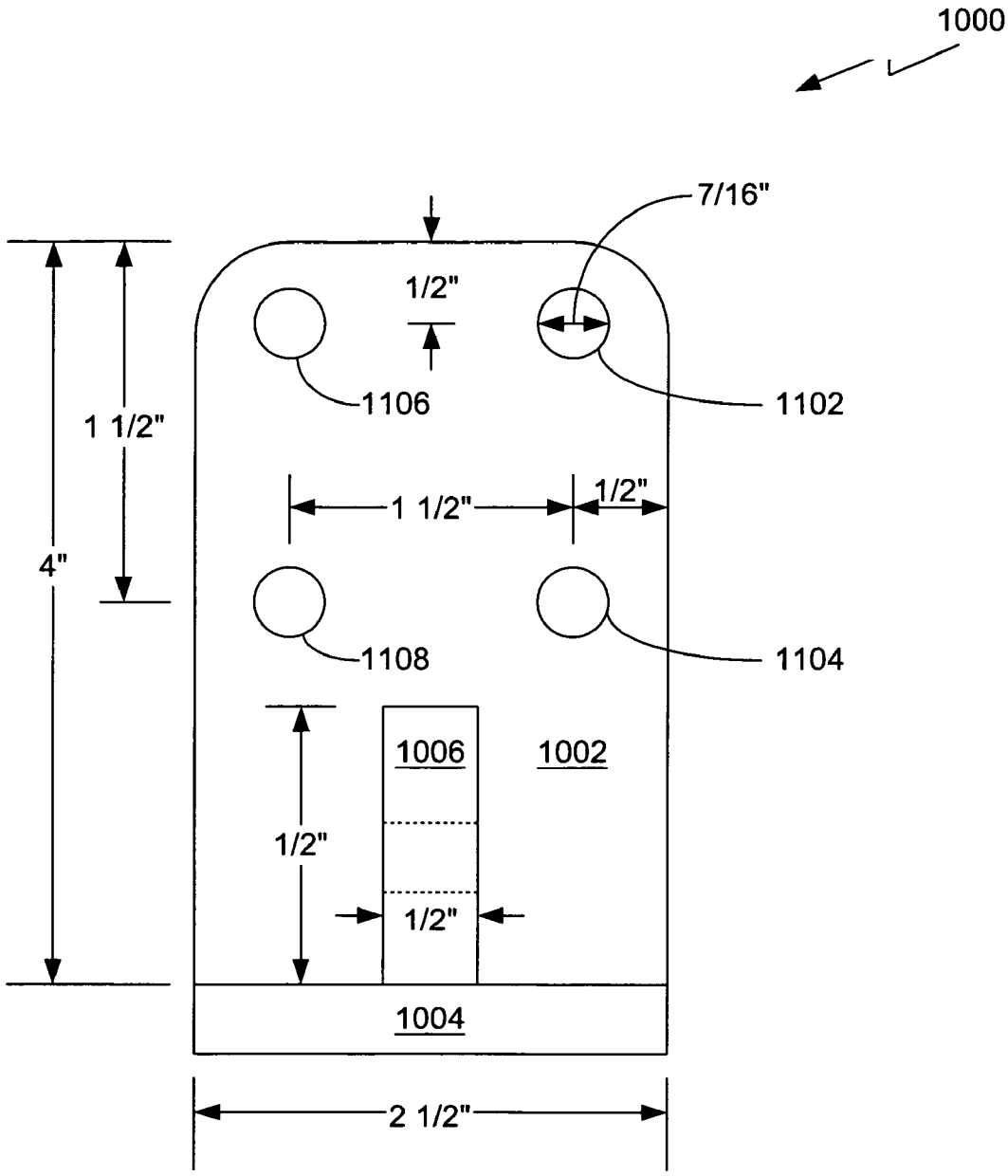
FIG. 11 illustrates another view of the spline assembly of FIG. 10, but facing the jamb plate.

Turning to FIG. 11, an illustration of another view of the spline assembly 1000 of FIG. 10, but facing the jamb plate 1002. The spline 1006 is seen as being a half-inch wide and sitting on the floor plate 1004. The jamb plate 1002 may have holes, such as 1102, 1104, 1106, and 1108 for bolts, screws, or other types of fasteners to secure the spline assembly 1000 to the doorjamb. It should be noted that the spline plate is secured to the doorjamb but does not support the weight of a door off the doorjamb, because the floor plate 1004 of the spline assembly 1000 rests on the floor.

Figure 12:
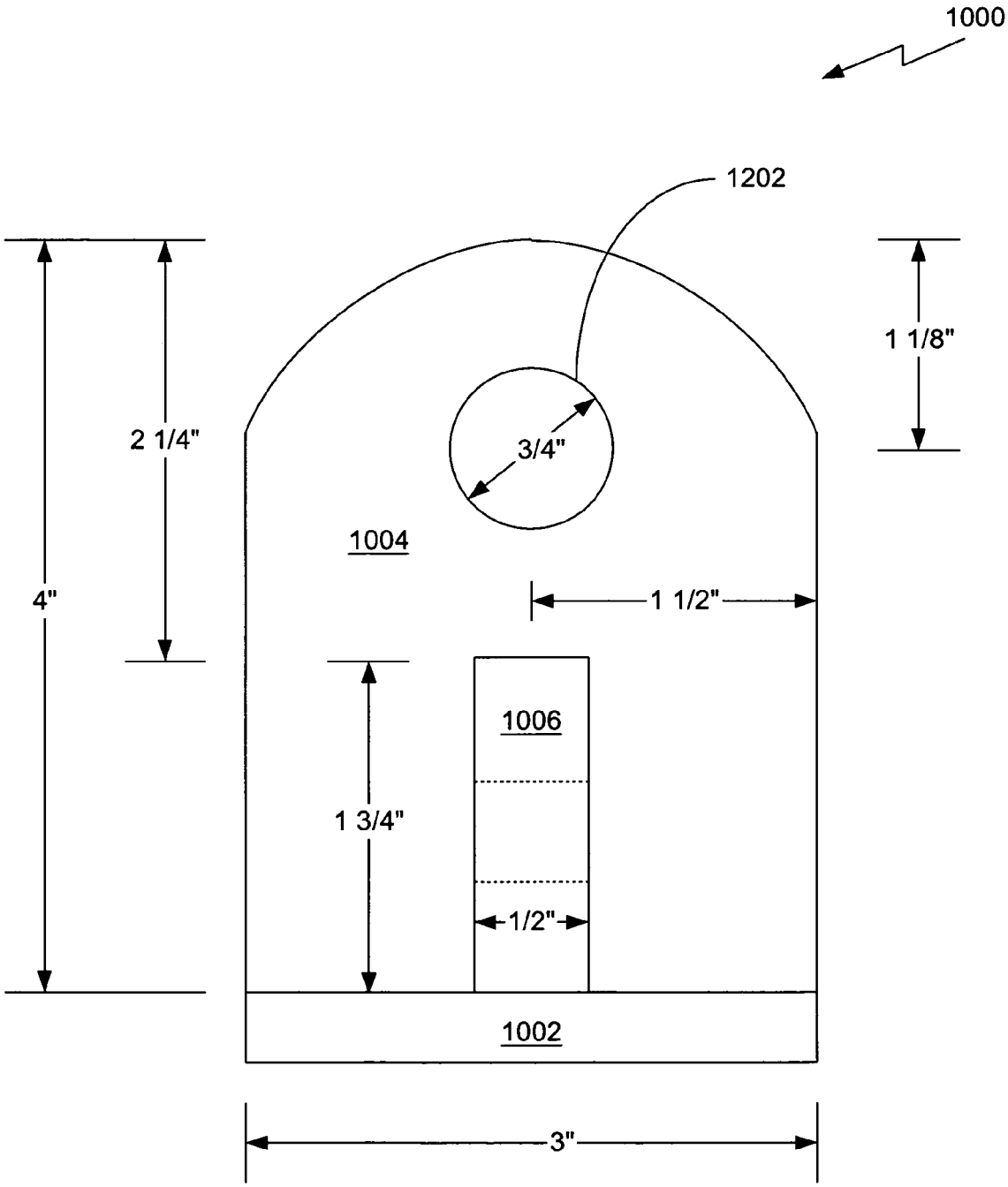
FIG. 12 illustrates another view of the spline assembly of FIG. 10, but facing the floor plate.

In FIG. 12, an illustration of another view of the spline assembly 1000 of FIG. 10, but facing the floor plate 1004 is shown. The floor plate 1004 rest upon the floor and may have a hole 1202 that aids in securing a door pin support. In other embodiments, the floor plate 1004 may have additional holes for fasteners to secure the floor plate 1004 to the floor.

Figure 13:
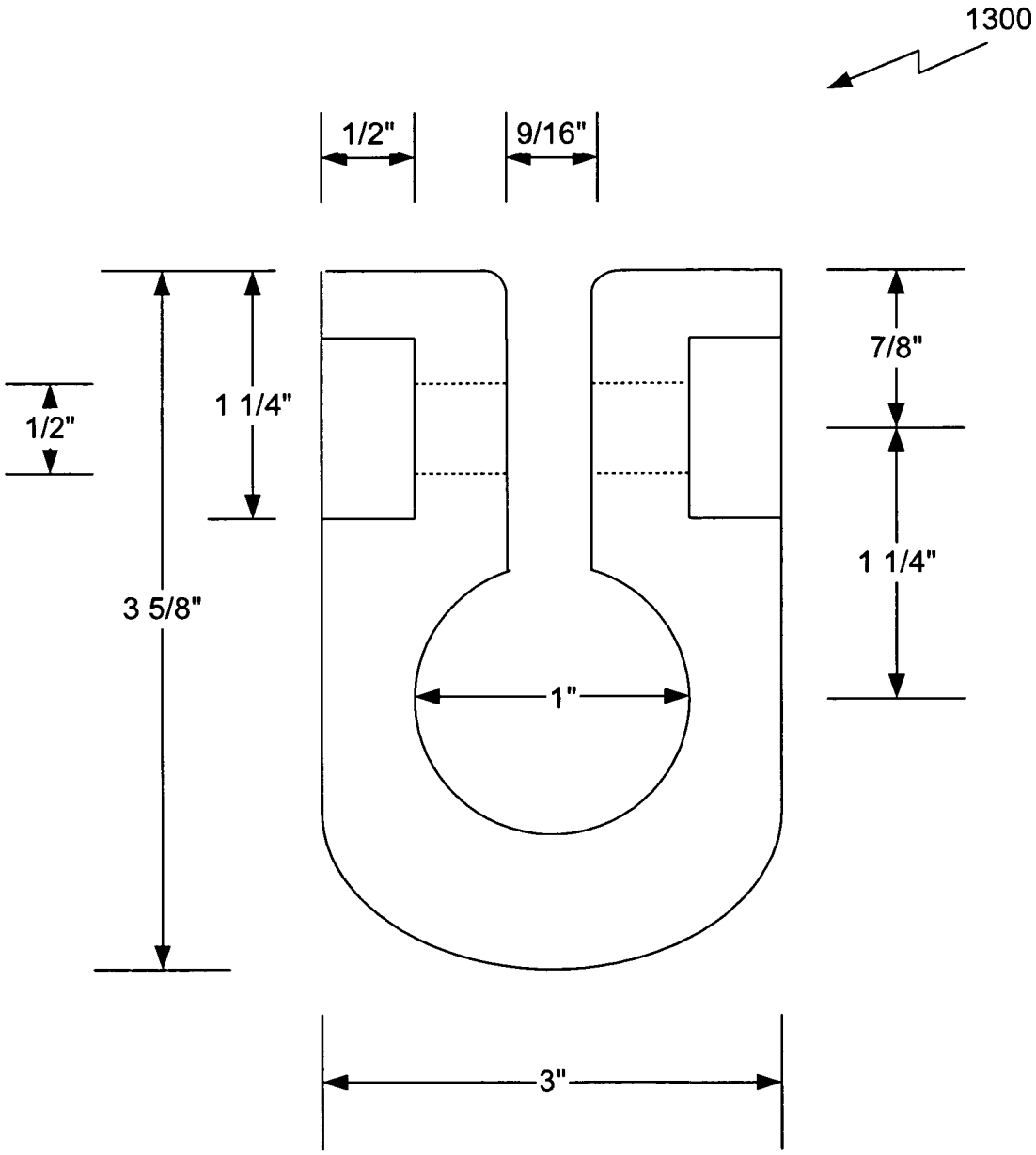
FIG. 13 illustrates a door pin support that secures to the spline assembly of FIG. 10.

Turning to FIG. 13, an illustration of a door pin support 1300 that secures to the spline assembly 1000 of FIG. 10 is shown. The door pin support 1300 may slide over spline 1006 with a hole the lines up with the spline hole 1008. A bolt or other type of fastener may then pass through the holes in the spline 1008 and door pin support 1300. A pin may then be supported and held firm in the one-inch opening in the spline hole 1008. In this arrangement the oscillator may be in beam that is attached to a door panel. In other examples, the door pin support may secure the oscillator and the door panel may secure a pin that is rotatable in the oscillator.

Figure 14:
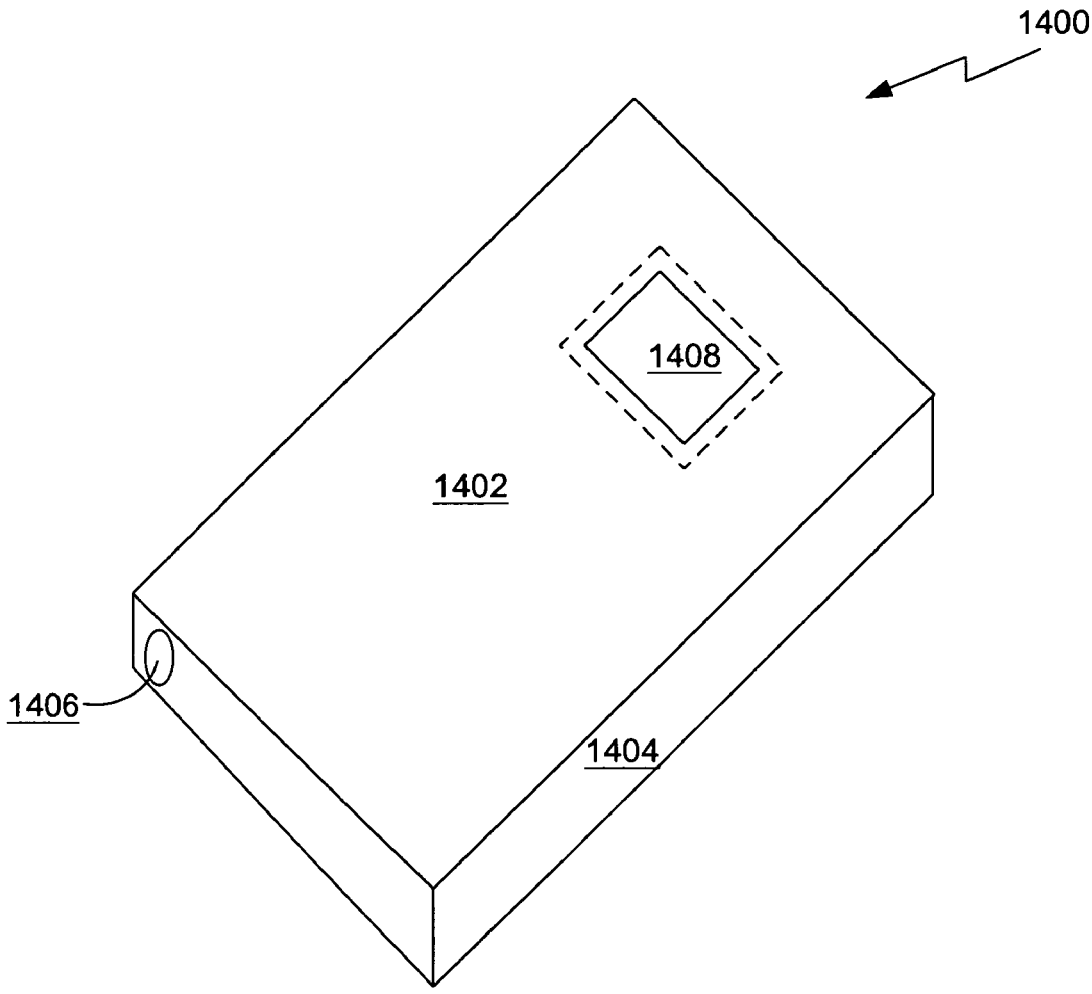
FIG. 14 illustrates a molded door panel with window in accordance with another embodiment of the invention.

FIG. 14 illustrates a molded door panel 1400 with window 1408 in accordance with another example of the invention. The molded door panel 1400 has a surface 1402 and edges 1404. The edges 1404 may form a frame by coating the edges with an elastomeric polyurethane spray. Typically two or more coats may be applied with the edges 1404 being coated first to form a more secure frame that prevents warping when the main sections of the surface 1402 of the door panel 1400 is coated. For example, the door panel or door panel and beam may be molded with a coating of KEVLON, a thermosetting, polymetric encapsolent, formed around a closed-cell insulator resistant to moisture, retaining its initial insulator properties even following prolonged exposure to water leakage, humidity, condensation and freeze-thaw cycling.

The core material of the door panel may be polystyrene, polyurethane, wood, metal, paperboard, fiberglass, or materials that form a frame for a panel. The panels may be an insolated door panel with the core material being composed of a material that slows the transfer of heat or cold. The molded door panel may be used with a full or partial beam 1406. One or more windows 1402 may be molded into the door and held in place by over spray of the coating material. The window 1402 may be made out of a Lexan polycarbonate. In other example implementations, the windows may be held in place by a frame that is secured with screws or other type fasteners.

A high-density panel (i.e. solid not molded) may also be used with a full or partial beam. Holes in the high-density panel may be formed in order to prevent stress bending of the panel when the beam is clamped onto the high-density panel.

The door panels may be used for all types of doors, including but not limited to oscillating self-centering traffic-doors. For example, garage doors, home access doors, semi-trailer doors, train car doors. Further more, molded panels may also be formed for use in partitions and dividers.

Figure 15:
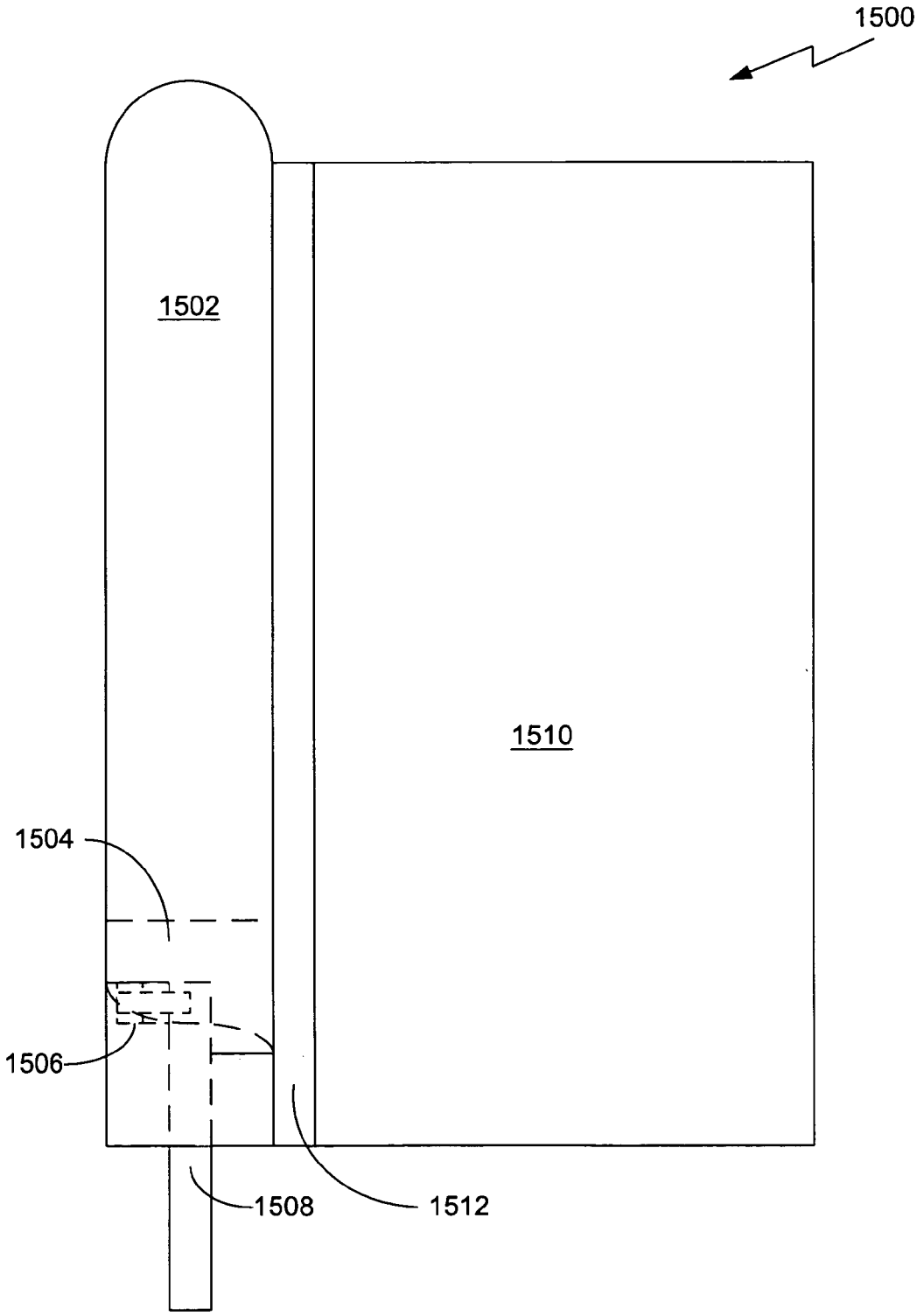
FIG. 15 illustrates a freestanding door with a post that contains an oscillator in accordance with another embodiment of the invention.

In FIG. 15, an illustration of a freestanding door 1500 with a beam 1502 that contains an oscillator 1504 in accordance with another embodiment of the invention. Such doors may be commonly found in bars and by sales counters and divide an area behind the bar or counter from the other public areas. The beam 1502 may be a full or partial beam and contain an oscillator 1504. The oscillator 1504 is secured in the beam 1502 and rest on one or more wheels or bearings 1506 that are attached to a pin 1508 that may be secured to the floor. The pin 1508 may be the sole secure point to support the beam and may be secured to a bracket bolted to the floor (not shown) or may have the pin 1508 embedded or sunken into the floor. The beam 1502 may have an area 1512 for clamping onto a door panel 1510, or may be molded to the panel as explained previously. In other implementations, the oscillator 1504 may be secured to a plate or pin on the floor, while one or more wheels or bearings are secured to a pin that is coupled to the beam.

The self-oscillating traffic-doors or other type of door may be placed into a test jig that holds the door stationary with the bottom shaft is allowed to fully rotate. The shaft has a pin and rollers that engage an oscillator as would occur during the normal operation of the door. The shaft is connected to an electric motor that may have gears for controlling torque via a coupler. The shaft is then rotated at a predetermined speed for a predetermined amount of time. A speed in the current example is 40 rotations per minute (RPM). The door assembly mounted in the floor to the fixture type frame directly below the beam next to jamb.

The door motion may be in the vertical direction only. This test may be complete after a predetermined number of rotations, such as 1,300,000 cycles of rotation with no impact on operation of shaft, rotator, or oscillator and no additional lubrication being applied. Upon termination of the test, the door and beam should function as prior to the test.

Another test of the door, may verify that the door panel with withstand impact and negative pressure. Negative pressure is typically what traffic doors experience because of the "chimney effect" found in a structure. Air is drawn through various openings from the perimeter of a store and traffic-doors prevent this air movement into sales area of a store. A self-oscillating traffic-door should be capable of being held in a closed position against typical negative pressure without requiring excessive force for an employee to open. A negative pressure no grater than 0.06 in. W.C. as measured on a manometer is considered ideal. Traffic doors that can hold closed to a higher negative pressure than 0.06 in. W.C. creates difficultly for employees to go through the opening and result in excessive wear on the moving parts and face of the door panel. This measure may apply to solid panel doors, molded panel doors and sandwich panel doors.

Impact resistance is a desirable feature for traffic doors. A ¼" thick solid panel should be impact resistant to 200 foot-pounds. For example, from a 1-inch diameter steel dart weighing 5 pounds dropped from a height of 40 feet or equivalent force if projected horizontally. A ½" thick solid panel should be impact resistant to a 200 foot-pounds. For example, a 1-inch diameter steel dart weighing 5 pounds dropped from a height of 40 feet or equivalent force if projected horizontally. Minor dents in the door panel that do not affect the alignment of the door are acceptable results.

A ⅛" thick sandwich paneled door panel should be impact resistant to 100 foot-pounds. For example, from a 1-inch diameter steel dart weighing 2.5 pounds dropped from a height of 40 feet or equivalent force if projected horizontally. ⅛" thick skins over a foam material panel should be impact resistant to a 200 foot-pounds. For example, a 1-inch diameter steel dart weighing 5 pounds dropped from a height of 40 feet or equivalent force if projected horizontally. Minor dents in the door panel that do not affect the alignment of the door are acceptable results.

The foregoing description of an implementation has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. An access door, comprising:

a door panel having an outer edge;

a beam attached to said outer edge of the door panel;

an oscillator located entirely within the beam and secured to the beam, said oscillator engages a support pin that is at least partially located in said beam to support the beam; and a coating on the door panel and on the beam, said coating assists in securing the beam to the door panel.

2. The access door of claim 1, where the door panel is a frame that is strengthened by the coating.

3. The access door of claim 1, where the door panel is a solid core door panel.

4. The access door of claim 1 core is made of insulating material.

5. The access door of claim 1, where the coating is a polymer.

6. The access door of claim 5, where the polymer is an elastomeric polyurethane.

7. The access door of claim 1, where the beam is attached to only a portion of the door panel.

8. An access door, comprising:

a door panel having an outer edge;

a beam attached to said outer edge of the door panel;

a pin secured in the beam that has at least one wheel that engages an oscillator, said oscillator is located entirely within the beam and said oscillator is secured to the beam; and a coating on the door panel and on the beam that assists in securing the beam to the door panel.

9. The access door of claim 8, where the door panel is a frame that is strengthened by the coating.

10. The access door of claim 8, where the door panel is a solid core door panel.

11. The access door of claim 8 where the core is made of insulating material.

12. The access door of claim 8, where the coating is a polymer.

13. The access door of claim 12, where the polymer is an elastomeric polyurethane.

14. The access door of claim 8, where the beam is attached to only a portion of the door panel.

15. A method for creating the access door of claim 1, comprising the steps of:

forming a core with edges and a top panel and a bottom panel;

coupling a beam to the core;

molding the core and beam together with a least at least one coat of a polymer.

16. The method of claim 15, where molding further includes the step of spraying the polymer on the core and beam such that the core is secured to the beam by the polymer.

17. The method of claim 16, where spraying further includes the steps of:

spraying the edges of the core; and spraying the top panel and the bottom panel of the core after the edges of the core have been sprayed.

18. The method of claim 15, where the core is made of insulating material.

19. The method of claim 15, where the polymer is an elastomeric polyurethane.

20. The method of claim 15, further includes the steps of:

placing a window in the core; and overspraying the window with the polymer in order to secure the window in the core.

21. The method of claim 15, where the thickness of the polymer is between ⅛" and ½" inclusive.

* * * * *